United States Patent [19]

Elton

[11] Patent Number: 4,986,927

[45] Date of Patent: Jan. 22, 1991

[54] SPOT AND STAIN REMOVER CONTAINING A MAJOR AMOUNT OF A VEGETABLE OIL

[76] Inventor: Lyle Elton, 5 Eagle Drive, Sherwood Park, Alberta, Canada, T8A 0E1

[21] Appl. No.: 466,013

[22] Filed: Jan. 16, 1990

[51] Int. Cl.[5] ..... C11D 1/655; C11D 3/382; C11D 9/38; C11D 9/48

[52] U.S. Cl. ..... 252/118; 252/89.1; 252/117; 252/121; 252/122; 252/153; 252/170; 252/171; 252/172; 252/173; 252/548; 252/551; 252/553; 252/558; 252/DIG. 5; 252/DIG. 14; 252/DIG. 19

[58] Field of Search ..... 252/89.1, 117, 118, 252/121, 122, 132, 153, 170, 171, 172, 173, 548, 551, 552, 553, 558, DIG. 5, DIG. 13, DIG. 14, DIG. 19

[56] References Cited

U.S. PATENT DOCUMENTS

| | | | |
|---|---|---|---|
| 3,658,985 | 4/1972 | Olson | 424/70 |
| 4,251,383 | 2/1981 | Kemp | 252/153 |
| 4,323,468 | 4/1982 | Grollier | 252/89.1 |
| 4,363,756 | 12/1982 | Sepulveda | 252/550 |
| 4,613,447 | 9/1986 | Hara | 252/91 |
| 4,673,526 | 6/1987 | Zabotto | 252/89.1 |
| 4,707,293 | 11/1987 | Ferro | 252/170 |
| 4,711,739 | 12/1987 | Kandathil | 252/139 |
| 4,738,792 | 4/1988 | Ertle | 252/118 |
| 4,747,977 | 5/1988 | Whitehead | 252/111 |
| 4,749,516 | 6/1988 | Brusky | 252/546 |
| 4,806,262 | 2/1989 | Snyder | 252/90 |
| 4,808,330 | 2/1989 | Chung | 252/170 |

*Primary Examiner*—Dennis Albrecht

*Attorney, Agent, or Firm*—George Haining Dunsmuir

[57] ABSTRACT

A relatively simple spot and stain remover composition contains approximately 60% by weight vegetable oil, 29.36 by weight water, 0.04% by weight formaldehyde, 1.6% by weight sodium xylene sulphonate, 1.6% by weight of the sodium salt of ether sulphate, 1.7% by weight of a 45% aqueous solution of potassium hydroxide, 4.4% by weight sulphonic acid, 1.2% by weight lauryl alkanolamide, and traces of a fragrance and a pink dye.

2 Claims, No Drawings

SPOT AND STAIN REMOVER CONTAINING A MAJOR AMOUNT OF A VEGETABLE OIL

BACKGROUND OF THE INVENTION

This invention relates to a stain remover composition.

For the most part, spot and stain remover compositions contain relatively expensive ingredients. A need exists for an inexpensive composition, which effectively removes stains.

The object of the present invention is to meet the above need by providing a relatively simple composition for removing spots and stains.

BRIEF SUMMARY OF THE INVENTION

Accordingly, the present invention relates to a spot and stain remover composition consisting essentially of 55 to 65% by weight vegetable oil, 26 to 32% by weight water, 0.03 to 0.05% by weight formaldehyde, 1.5 to 1.7% by weight sodium xylene sulphonate, 1.5 to 1.7% by weight of the sodium salt of ether sulphate, 1.5 to 1.9% by weight of a 45% aqueous solution of potassium hydroxide, 4.3 to 4.5% by weight sulphonic acid, and 1.1 to 1.3% by weight lauryl alkanolamide.

DESCRIPTION OF THE PREFERRED EMBODIMENT(S)

The present invention is based on the surprising discovery that an effective spot and stain remover can be produced using a vegetable oil of the type sold under the brand name "Scotch Buy" (trade mark). The vegetable oil in question is basically a canola or rapeseed oil. The composition has been used to remove, inter alia, grease, dried blood, axle grease, grass stains, and tomato and other food stains.

The preferred composition contains 60% by weight vegetable oil, 25.36% by weight water, 0.04% by weight formaldehyde, 1.6% by weight sodium xylene sulphonate in the form of an aqueous solution, 1.6% by weight ether sulphate sodium salt (60%) active), 1.7% by weight potassium hydroxide in the form of a 45% aqueous solution, 4.4% by weight sulphonic acid and 1.2% by weight lauryl alkanolamide in the form of coconut oil.

The reference to 60% active ether sulphate is made above, because the ether sulphate is available in different strengths, e.g. 30% and 45%, the 60% active being the most common.

The compositions prepared in accordance with the present invention will contain traces of a pink or other coloured dye and fragrance to mask the normal odours of the active ingredients.

Thus, there has been described a relatively simple, inexpensive, yet effective spot and stain remover.

What I claim is:

1. A spot and stain remover composition consisting essentially of 55 to 65% by weight vegetable oil, 26 to 32% by weight water, 0.03 to 0.05% by weight formaldehyde, 1.5 to 1.7% by weight sodium xylene sulphonate, 1.5 to 1.7% by weight of the sodium salt of ether sulphate, 1.5 to 1.9% by weight of a 45% aqueous solution of potassium hydroxide, 4.3 to 4.5% by weight sulphonic acid, and 1.1 to 1.3% by weight lauryl alkanolamide.

2. A spot and stain remover composition consisting essentially of 60% by weight vegetable oil, 25.3% by weight water, 0.04% by weight formaldehyde, 1.6% by weight sodium xylene sulphonate in the form of an aqueous solution, 1.6% by weight of the sodium salt of ether sulphate, 1.7% by weight potassium hydroxide in the form of a 45% aqueous solution, 4.4% by weight sulphonic acid and 1.2% by weight lauryl alkanolamide.

* * * * *